US006907934B2

(12) United States Patent
Kauffman et al.

(10) Patent No.: US 6,907,934 B2
(45) Date of Patent: Jun. 21, 2005

(54) UNIVERSAL TOP-DRIVE WIRELINE ENTRY SYSTEM BRACKET AND METHOD

(75) Inventors: Vernon E. Kauffman, Friendswood, TX (US); Dwight Reuben LeBlanc, Alvin, TX (US)

(73) Assignee: Specialty Rental Tool & Supply, L.P., Alvin, TX (US)

( * ) Notice: Subject to any disclaimer, the term of this patent is extended or adjusted under 35 U.S.C. 154(b) by 142 days.

(21) Appl. No.: 10/249,033

(22) Filed: Mar. 11, 2003

(65) Prior Publication Data

US 2004/0221994 A1 Nov. 11, 2004

(51) Int. Cl.[7] ..... E21B 19/02; E21B 19/16; E21B 3/04

(52) U.S. Cl. ..... 166/379; 166/75.14; 166/77.2; 166/85.5; 248/200; 254/411; 254/415

(58) Field of Search ..... 166/378, 379, 166/381, 382, 384, 385, 75.11, 77.1, 77.2, 85.1, 85.5, 75.14, 242.2; 248/200; 254/405, 411, 415, 403, 408

(56) References Cited

U.S. PATENT DOCUMENTS

| | | | | | |
|---|---|---|---|---|---|
| 2,581,298 | A | * | 1/1952 | De Forest | 254/415 |
| 2,630,180 | A | * | 3/1953 | Summers | 166/77.1 |
| 3,104,094 | A | * | 9/1963 | Liem et al. | 254/399 |
| 3,116,793 | A | * | 1/1964 | McStravick | 166/285 |
| 3,292,908 | A | * | 12/1966 | Thompson | 254/398 |
| 3,385,563 | A | * | 5/1968 | Stinson, Jr. | 254/415 |
| 3,920,076 | A | * | 11/1975 | Laky | 166/384 |
| 4,090,573 | A | * | 5/1978 | Rankin | 175/45 |
| 4,462,733 | A | * | 7/1984 | Langowski et al. | 414/22.71 |
| 4,469,171 | A | * | 9/1984 | Mine | 166/85.5 |
| 4,473,214 | A | * | 9/1984 | Sterner et al. | 254/415 |
| 4,480,818 | A | * | 11/1984 | Frank | 254/411 |
| 5,501,287 | A | * | 3/1996 | Loeser | 175/173 |
| 5,735,351 | A | * | 4/1998 | Helms | 166/384 |
| 5,975,203 | A | * | 11/1999 | Payne et al. | 166/77.3 |
| 6,105,939 | A | * | 8/2000 | Vance et al. | 254/405 |
| 6,250,608 | B1 | * | 6/2001 | Ridley | 254/415 |
| 6,378,844 | B1 | * | 4/2002 | Weaver | 254/134.3 R |
| 6,536,541 | B2 | * | 3/2003 | Pedrelli | 175/135 |
| 2002/0125014 | A1 | * | 9/2002 | Dearing et al. | 166/384 |
| 2003/0010505 | A1 | * | 1/2003 | Gipson | 166/384 |
| 2003/0029618 | A1 | * | 2/2003 | Schempf et al. | 166/343 |
| 2003/0159821 | A1 | * | 8/2003 | Andersen et al. | 166/77.1 |

* cited by examiner

*Primary Examiner*—David Bagnell
*Assistant Examiner*—Jennifer Gay
(74) *Attorney, Agent, or Firm*—David B. Dickinson; Lundeen & Dickinson, LLP

(57) ABSTRACT

A bracket and tension rod device is mounted to a top-drive dolly to carry the weight of a sheave wheel assembly. The device is deployed by connecting the sheave wheel assembly to a rigid dolly arm with an adjustable tension rod to relieve a gooseneck from adverse tensile, compressive and bending forces from the movement of a wireline through the sheave assembly.

41 Claims, 9 Drawing Sheets

UNIVERSAL TOP-DRIVE WIRELINE ENTRY SYSTEM BRACKET AND METHOD

BACKGROUND OF INVENTION

The present invention generally relates to a bracket for support of a wireline entry device adjacent a top-drive unit on an oil and gas drilling platform. More particularly, the present invention relates to a bracket or mounting system for supporting a wireline sheave assembly adjacent a top-drive of a drilling ship, platform, or rig to minimize stress on a gooseneck assembly and pressure control system.

The majority of large oil rigs operating throughout the world are using top-drive units to speed the assembly of drill string and to permit rapid, almost continuous, drilling. Wireline operations required on deep wells using these expensive rigs can be a severe bottleneck if they cannot be carried out with the expediency and efficiency which is sought by all drilling contractors. To remedy the problem of inserting a wireline in a top-drive unit, a top-entry apparatus providing a safe and effective means of inserting and manipulating a wireline in a top-drive unit has been developed and is the subject of U.S. Pat. No. 5,735,351 hereby incorporated herein by reference for background of this technology.

As the wells being drilled by top-drive units has increased and the depth of the wells being attempted by these top-drives has increased, the need for heavier and more robust wireline equipment has likewise be appreciated. Stringing wireline in well bore from above the top drive can be dangerous if the sheave and pulley system used is inadequate to support the weight of the increased wireline diameters (from 3/16" to over ½") required to go to the depths currently being drilled. Accordingly, the need for robust sheave and pulley systems increases the stresses on the wireline entry gooseneck and the pressure control systems (i.e. packing) which is required to allow the wireline to be paid out to the tubular suspended below under possible pressures.

SUMMARY OF INVENTION

Preferred embodiments of the present invention disclose improvements to a top entry access system that include a bracket and a load member connected to components of a top-drive unit (for example, a VARCO top-drive) to prevent damage to top entry access system components. The brackets preferably include tie brackets for connecting with lower clevis hitches of load members. When employed, the systems act to relieve stresses in the gooseneck of the top entry access system that can result from the weight and wireline loads experienced from the weight of the sheave assembly. Preferably, the position of the load member is adjustable through the manipulation of a turnbuckle on the load member itself or the mounting locations at the tie bracket of the sheave wheel. Alternatively, the top entry access system can be used with slickline, coiled tubing, or fiber optic cable if wireline is not deployed. Furthermore, the load member of alternative embodiments to the preferred embodiment can be constructed as a single solid bar, a pair of solid bars connected in series with a turnbuckle therebetween, braided wire rope, a hydraulic ram, and a ball screw device. Additionally, the preferred embodiment includes a method for using the present invention in top-entry wireline (and other conduit) operations.

DETAILED DESCRIPTION

Figure 1:
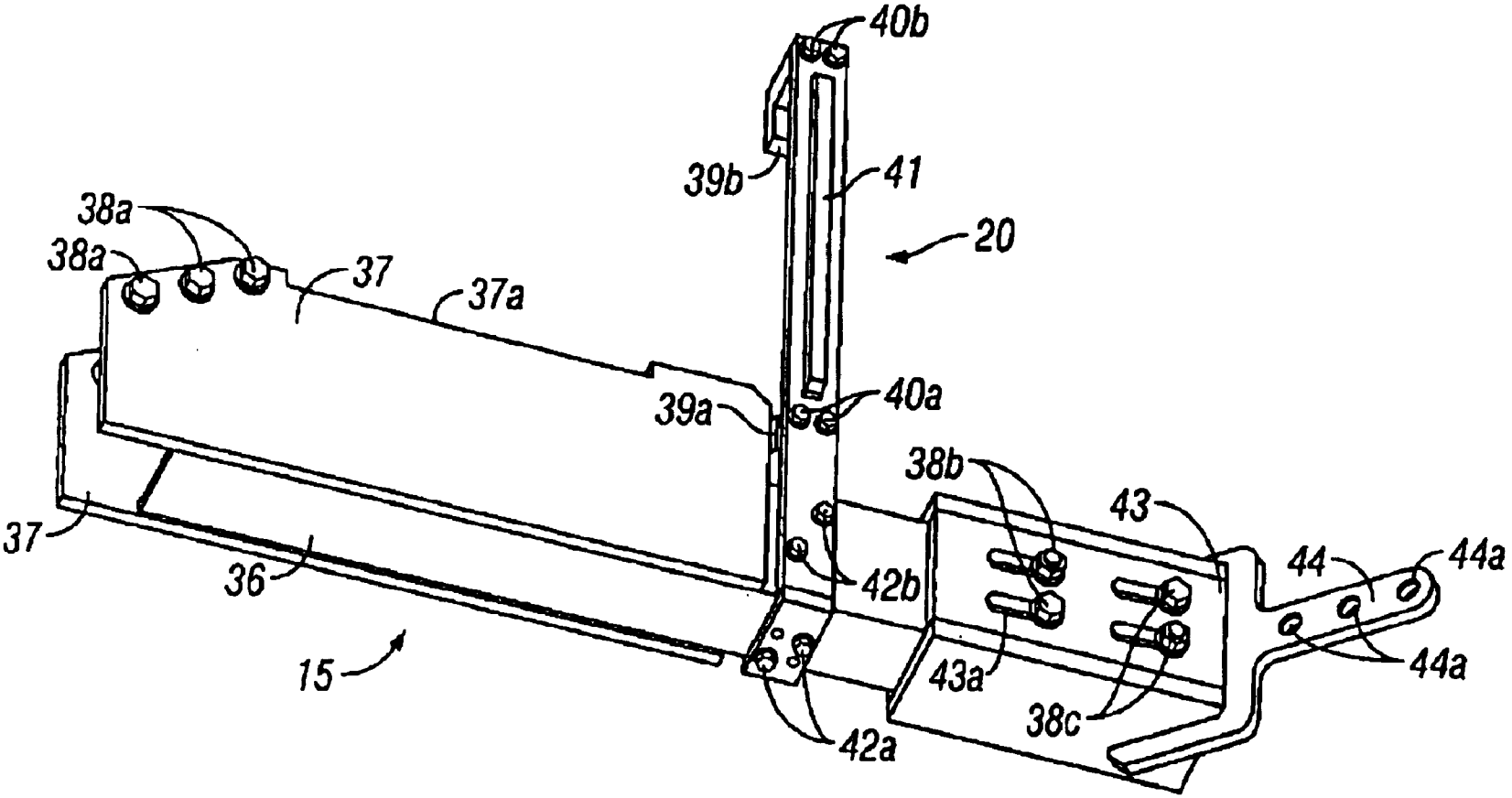
FIG. 1 is a perspective view drawing of a bracket assembly in accordance with a preferred embodiment of the present invention.
Figure 3:
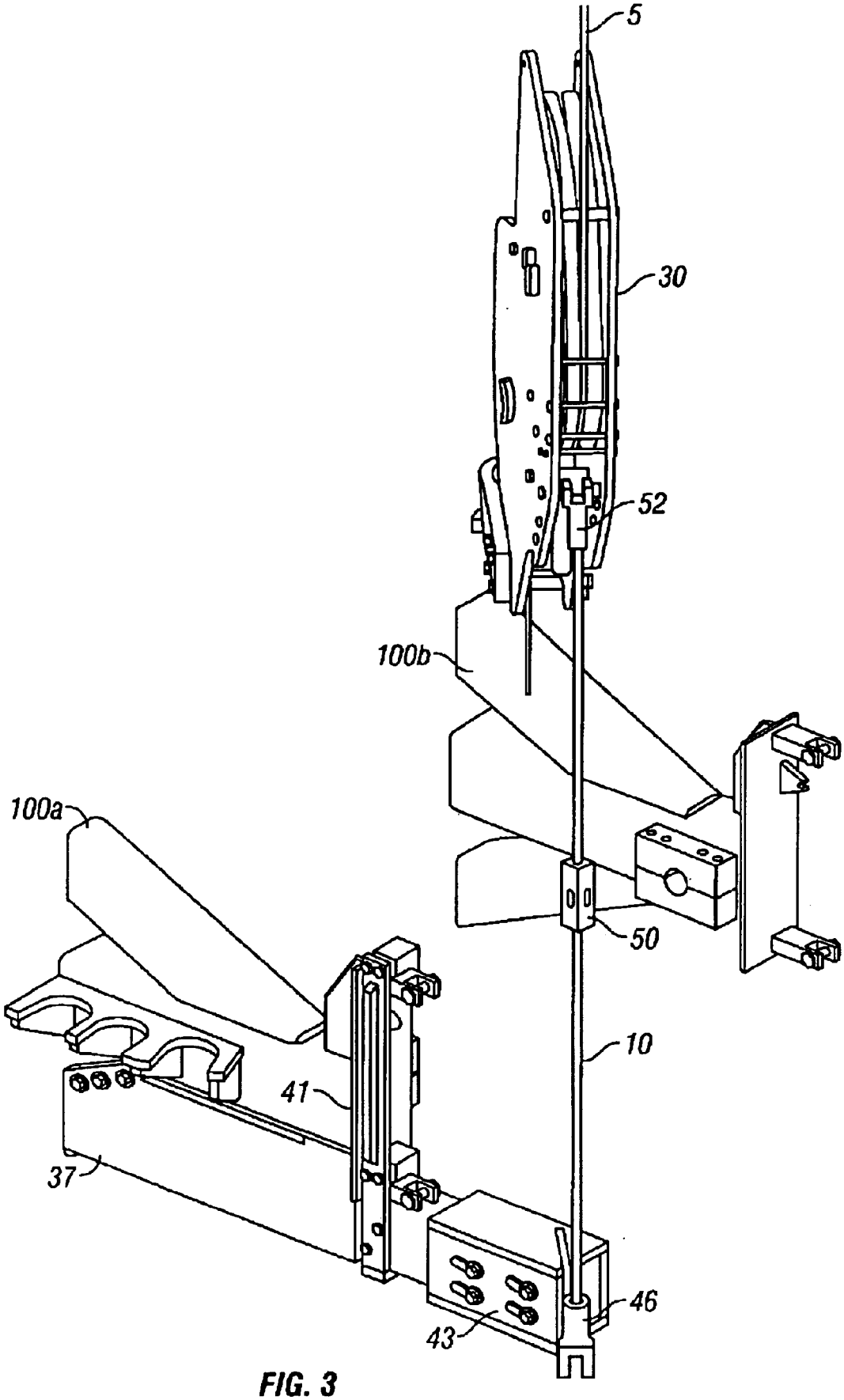
FIG. 3 is a left side front perspective view drawing showing the bracket assembly of FIG. 1 and the tension rod assembly of FIG. 2 used in conjunction with a wireline top entry access system sheave assembly.
Figure 4:
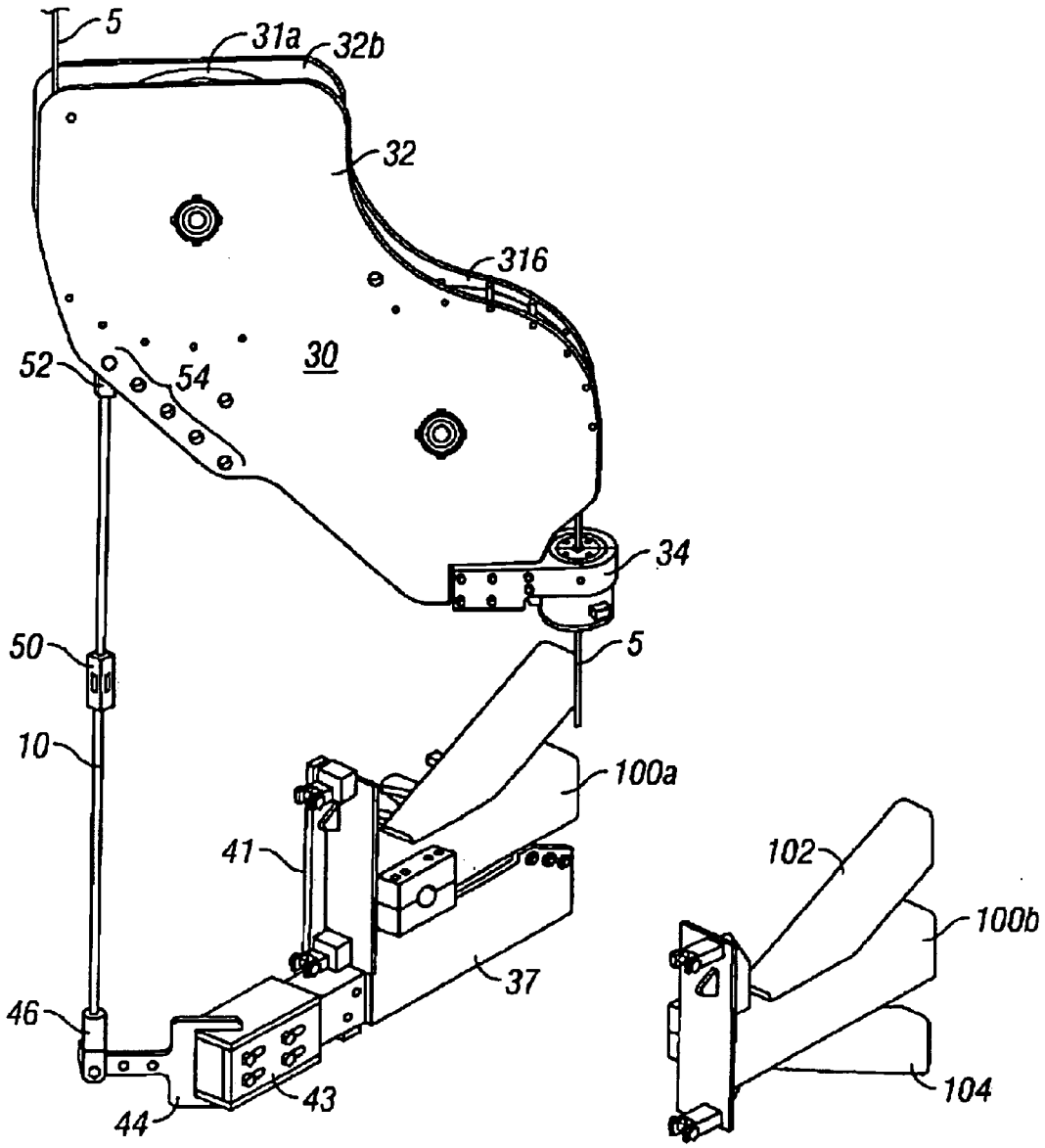
FIG. 4 is a right side front perspective view drawing showing the bracket assembly of FIG. 1 and the tension rod assembly of FIG. 2 used in conjunction with a wireline top entry access system sheave assembly.

Referring initially to FIG. 1, a bracket assembly 15 in accordance with a preferred embodiment of the present invention is shown. Bracket assembly 15 is preferably constructed from a rectangular extension arm 36 to which two gusset brackets 37 are laterally attached. Rectangular extension arm 36 and gusset brackets 37 are designed to slidably engage the lower gusset or strut of an existing top-drive dolly (shown as items 100*a, b* in FIGS. 3–4). An open channel in the rectangular extension arm 36 mates with the sloping support arm of the dolly (best seen in FIGS. 3 and 4). A notch 37*a* is provided on the upper edge of each gusset bracket 37 to clear obstructions of an upper gusset 102 (FIGS. 3–4). Hex bolts 38*a* are then inserted in holes provided in the upper edge of each gusset bracket 37 to form a cage around the adjacent interior edge of a lower gusset 104 (FIGS. 3–4). The angle of the holes in the end of the gusset brackets 37 approximates the slope of the dolly gusset adjacent thereto. Furthermore, while bracket assembly 15 is shown mounted to the left gusset 100*a* in FIGS. 3–4, is should be understood that the bracket assembly could just as easily be attached to the right gusset 100*a* if the preferences of the end user so desire.

Referring again to FIG. 1, the bracket assembly is further secured to top drive assembly gussets by an optional L-shaped hanger assembly 20. L-shaped hanger assembly 20 is connected to the bottom of the rectangular extension arm 36 by bolts 42*a* and on its lateral edge by bolts 42*b*. Hanger assembly 20 is shown ribbed for strength-by strip 41 which prevents the hanger assembly from movement once in place. Additional L-shaped attachments 39 are connected to the hanger assembly 20 to allow the hanger to engage the upper and lower edges of the guard assembly on a standard top-drive assembly. Bolts 40*a* extend through hanger assembly 20 and compressively hold the top-drive guard by bracket 39*a* on the guard's lower edge. Likewise, bolts 40*b* extend through hanger assembly 20 and compressively hold the top-drive guard by bracket 39*b* on the guard's upper edge.

Referring still to FIG. 1, an adjustment cap 43 is slidably engaged over the end of extension arm 36. Adjustment cap 43 is configured to be slidably adjustable along the length of extension arm 36 with the use of slots 43*a* and securing bolts 38*b* and 38*c*. Adjustment cap 43 further includes a clevis tie bracket 44 at its distal end. Tie bracket includes a plurality of holes 44*a* for adjustably mounting a clevis hitch (or a yoke end linkage) thereto. Sliding cap 43 thus allows an operator to fine-tune its position to achieve optimal position for clevis tie bracket 44.

Figure 2:
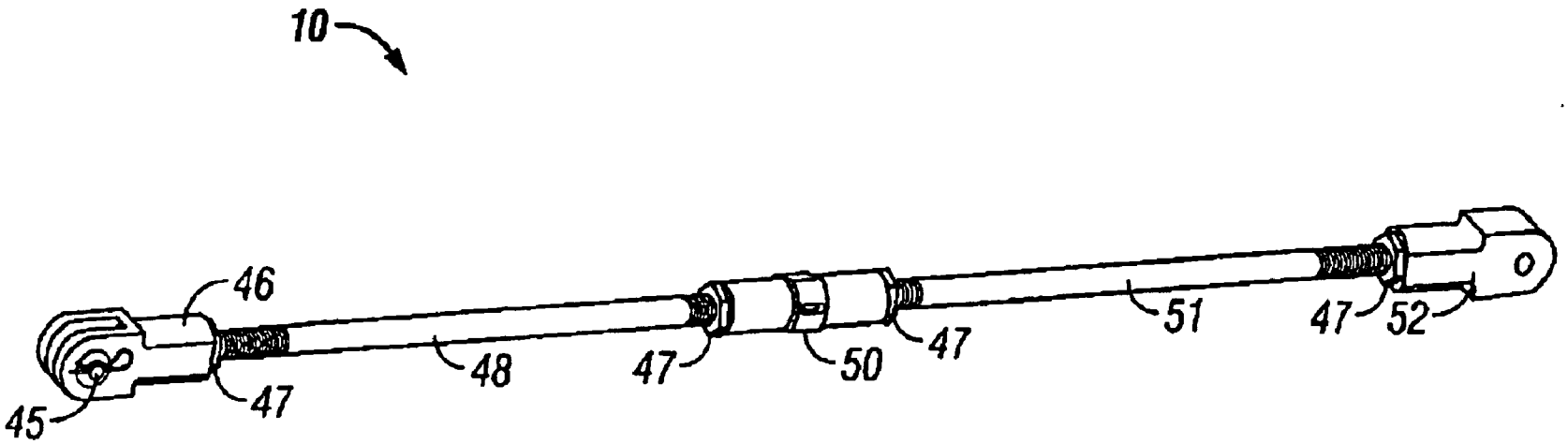
FIG. 2 is a perspective view drawing of a tension rod assembly in accordance with a preferred embodiment of the present invention.

Referring now to FIG. 2, a tension rod assembly 10 for connection with turnbuckle tie bracket 44 of FIG. 1 is shown. Tension rod assembly 10 includes an upper lug 52, an upper adjustment rod 51, a turnbuckle 50, a lower adjustment rod 48, and a lower lug 46. Lower lug 46 is constructed as a clevis (or yoke linkage) so that it can be placed over the end of clevis hitch tie bracket (44 of FIG. 1) and secured with a shear pin and cotter pin assembly 45. Lower adjustment rod 48 is then threaded into lower end of turnbuckle 50. Upper adjustment rod 51 extends from upper end of turnbuckle 50 and terminates into upper lug 52. Upper lug 52, as shown more clearly in FIGS. 3–4, is connected to a Top Entry Access System sheave wheel 30 at any one of a plurality of mounting locations 54 with a shear pin. Turnbuckle 50 is preferably constructed such that the threads at one end are left hand threads so that rotation of turnbuckle 50 either extends or retracts adjustment rods 48, 51 simultaneously. Because connections between turnbuckle 50, rods 48, 51, and lugs 46, 52 are all threaded connections, hex jam nuts 47 can be used restrict movement thereof.

Referring now to FIGS. 3–4 together, a sheave wheel assembly 30 is shown in conjunction with bracket assembly 15, and tension rod assembly 10. Sheave wheel assembly 30 generally includes a pair of large diameter sheave wheels 31*a*, 31*b* sandwiched between a pair of contoured plates 32*a*, 32*b*. A gooseneck 34 connects sheave wheel assembly 30 to the top of a top drive assembly (not shown). Wireline cable 5, extends from above sheave wheel 30, underneath wheel 31*a*, and over wheel 31*b* through pack off assembly and into gooseneck 34 to wellbore.

For deep wells, sheave wheel assembly 30 can weigh as much as 1,500 lbs (680 kg.). If this much weight were allowed to rest solely on gooseneck 34, substantial bending forces would be introduced into gooseneck 34 and pressure control assembly (not shown) which could damage assembly 34 and thereby increase the risk of failure of the pressure control system. Furthermore, the manipulation of wireline 5 during wellbore operations can move sheave assembly 30 and place considerable stresses on gooseneck 34. Particularly, when large loads (as are often seen in deep water drilling operations) are pulled upward on wireline 5, the stress to gooseneck 34 can be intense. When coupled with the lateral forces introduced into the sheave assembly by the movement and manipulation of a wireline 5 in sheave wheel assembly 30, even more substantial damage could result to gooseneck 34 and pack assembly.

The installation of the present bracket assembly 15 and tension rod 10 therefore allows the operator to adjust (by manipulation of turnbuckle 50) the pre-load to sheave assembly 30 to completely counterbalance the forces impinging on gooseneck 34. These forces are then carried by the dolly extensions 100*a* and 100*b*. Depending on loading conditions that are expected to be experienced by sheave assembly 30 and wireline 5, the amount of pre-load in tension rod assembly 10 can be quickly and easily adjusted. While nomenclature suggests that tension rod assembly 10 is only capable of tensile loading, it should be understood by one skilled in the art that tension rod assembly 10 is capable of carrying both tensile and compressive loads. As such, an operator can adjust mounting points 54, 44*a* and turnbuckle 50 to adjust the load condition experienced by tension rod assembly 10, and subsequently gooseneck 34.

Figure 5:
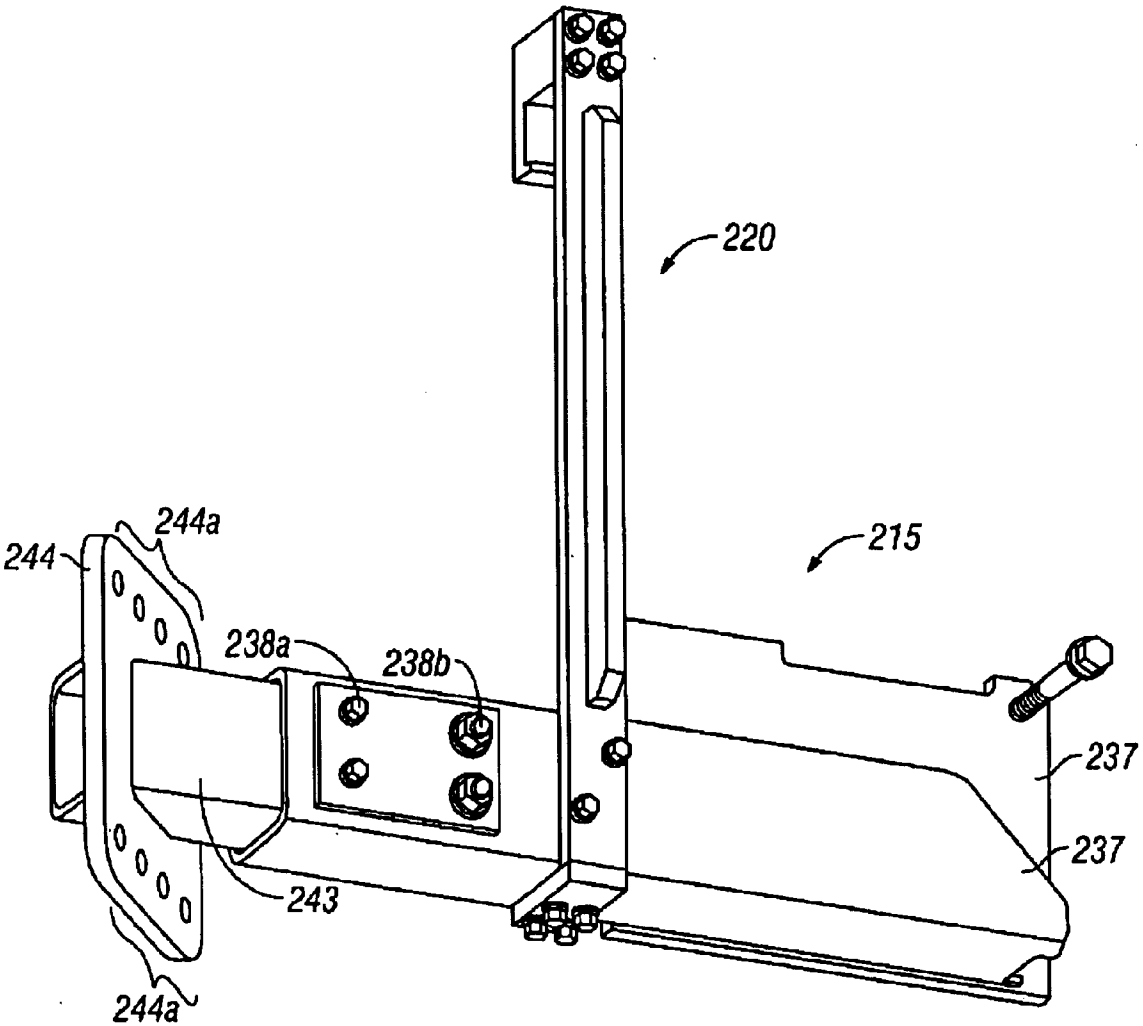
FIG. 5 is a perspective view drawing of a bracket assembly in accordance with a second preferred embodiment of the present invention.

Referring now to FIG. 5, a first alternative preferred embodiment of a bracket assembly 215 in accordance with the present invention is shown. Bracket assembly 215 includes an L-shaped hanger assembly 220, a pair of gusset brackets 237, and a square-shaped tie bracket 244. Tie bracket 244 is angled from axis of bracket assembly 215, is disposed upon a sliding adjustment arm 243, and includes a plurality of mounting holes 244*a* for the attachment of a clevis hitch or yoke end linkage thereto. Sliding adjustment arm 243 in combination with bolts 238*a* and nuts 238*b* allows for the positioning and fine-tuning of tie bracket 244 by operator.

Figure 6:
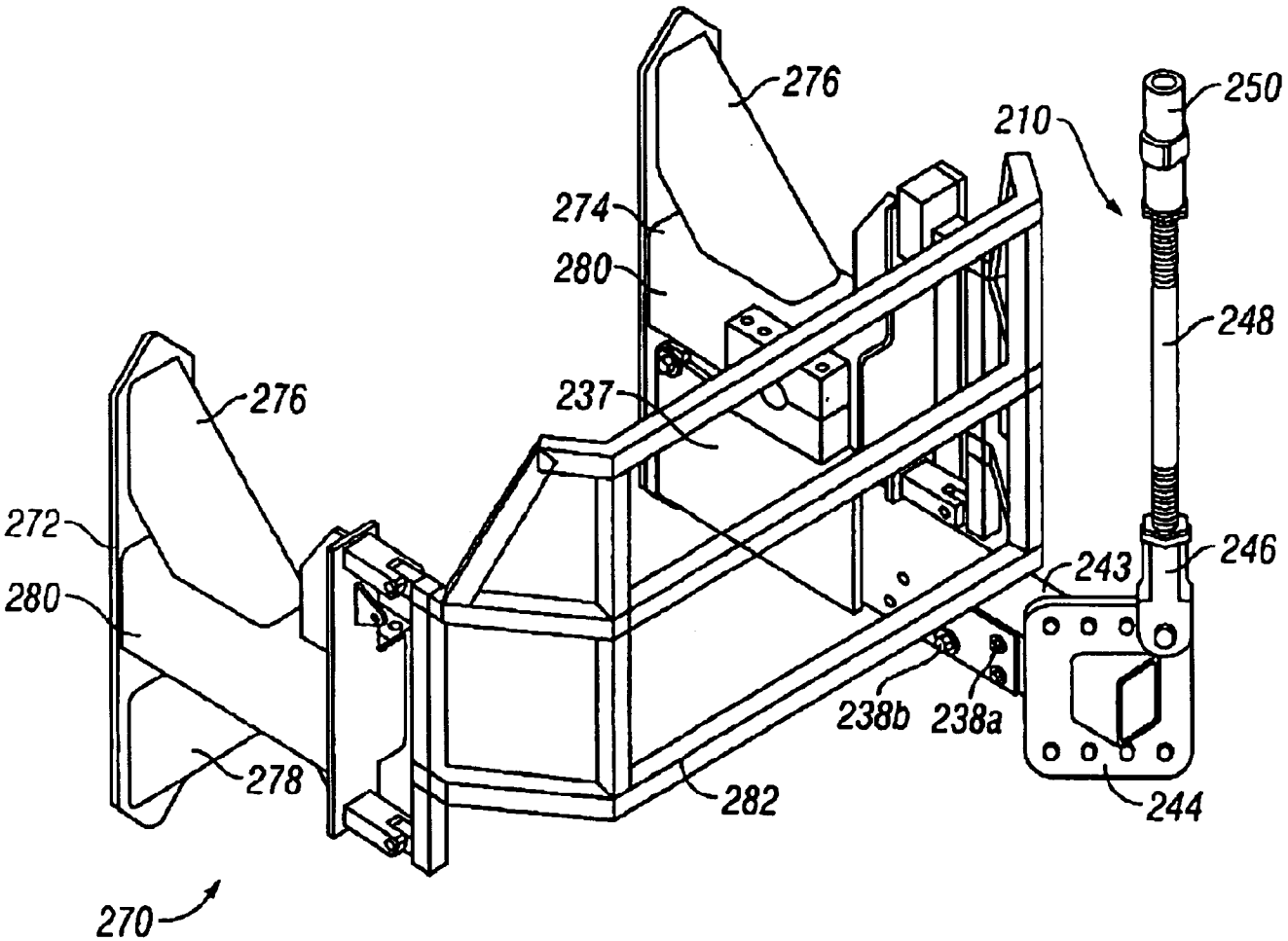
FIG. 6 is a right side front perspective view drawing showing the bracket assembly of FIG. 5 mounted to a dolly of a top drive drilling apparatus.

Referring now to FIG. 6, bracket assembly 215 is shown attached to portions of a dolly 270 of a top drive drilling assembly (not shown). Because pre-existing dolly assemblies 270 vary by manufacturer, size, configuration, and style, the attachment scheme for bracket assembly 215 varies as well. Dolly 270 of FIG. 6 includes a pair of arms 272, 274, each with an upper 276, lower 278, and middle 280 truss. Dolly 270 of FIG. 6 also includes a guard rail assembly 282 to prevent injury and to keep unwanted equipment clear. Bracket assembly 215 is installed by placing it over lower truss 278 of dolly arm 274 and bolting it in place. Because components of drilling rigs are often leased or purchased at high cost from differing vendors, it is important that permanent modifications are avoided whenever possible. As such, bracket assembly 215 is bolted into place upon lower truss 278 of dolly 274 without such modifications. After secured in place, a tension rod assembly 210, similar to that of FIG. 2, is attached to the tie bracket 244 at a lower lug 246. The length of tension rod assembly 210 can be adjusted by turning turnbuckle 250 to lengthen or shorten the length of an adjustment rod 248.

Figure 7:
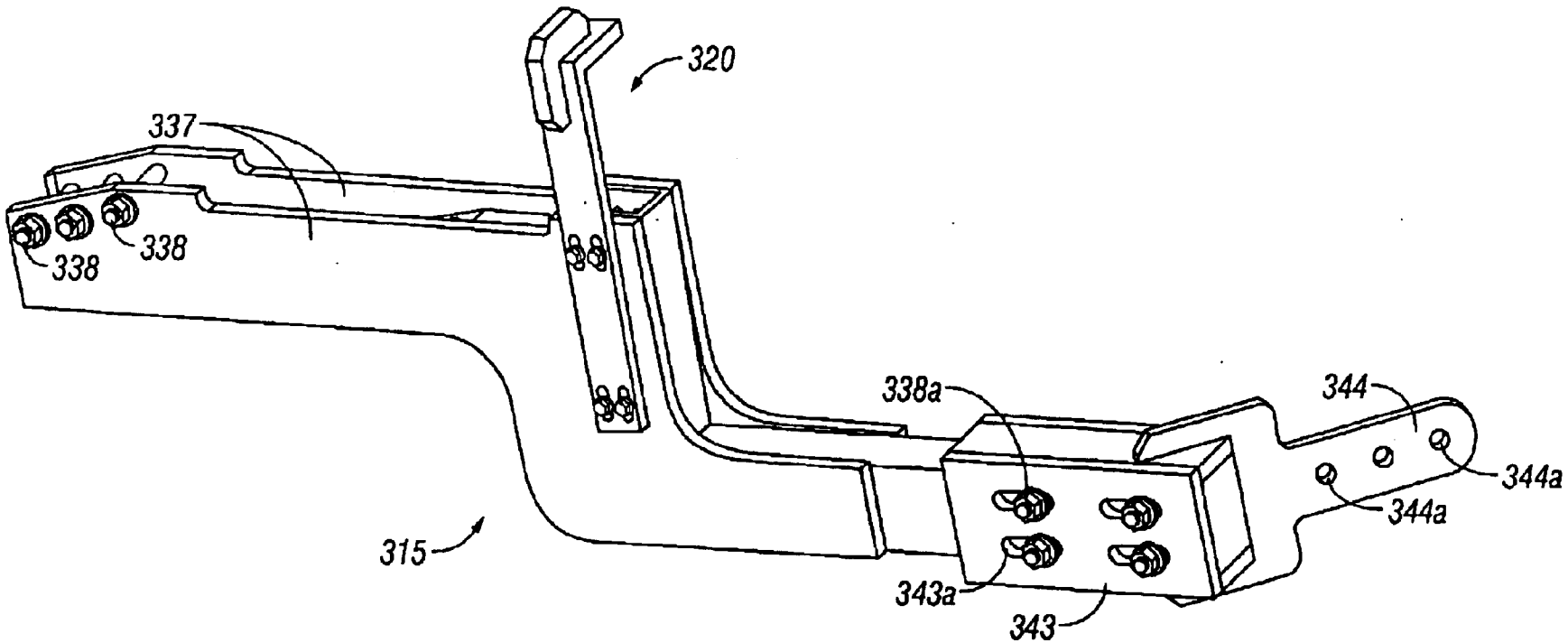
FIG. 7 is a perspective view drawing of a bracket assembly in accordance with a third preferred embodiment of the present invention.

Referring now to FIG. 7, a second alternative preferred embodiment of a bracket assembly 315 in accordance with the present invention is shown. Like earlier embodiments, bracket assembly 315 includes an optional L-shaped hangar assembly 320, a pair of gusset brackets 337, a sliding adjustment cap 343 with a tie bracket 344 thereattached. Tie bracket 344 includes a plurality of holes 344*a* for receiving a clevis hitch or a yoke end linkage (not shown). Bracket assembly 315 is designed for applications upon top drive dollies where brackets 15, 215 of FIGS. 1, 5 will not fit because of space considerations. As with brackets 15, 215, bracket 315 is bolted in place with a plurality of bolts and nuts 338 and adjustment cap includes slots 343*a* and bolts 338*a* to adjust and fine-tune positioning of tie bracket 344.

Figure 8:
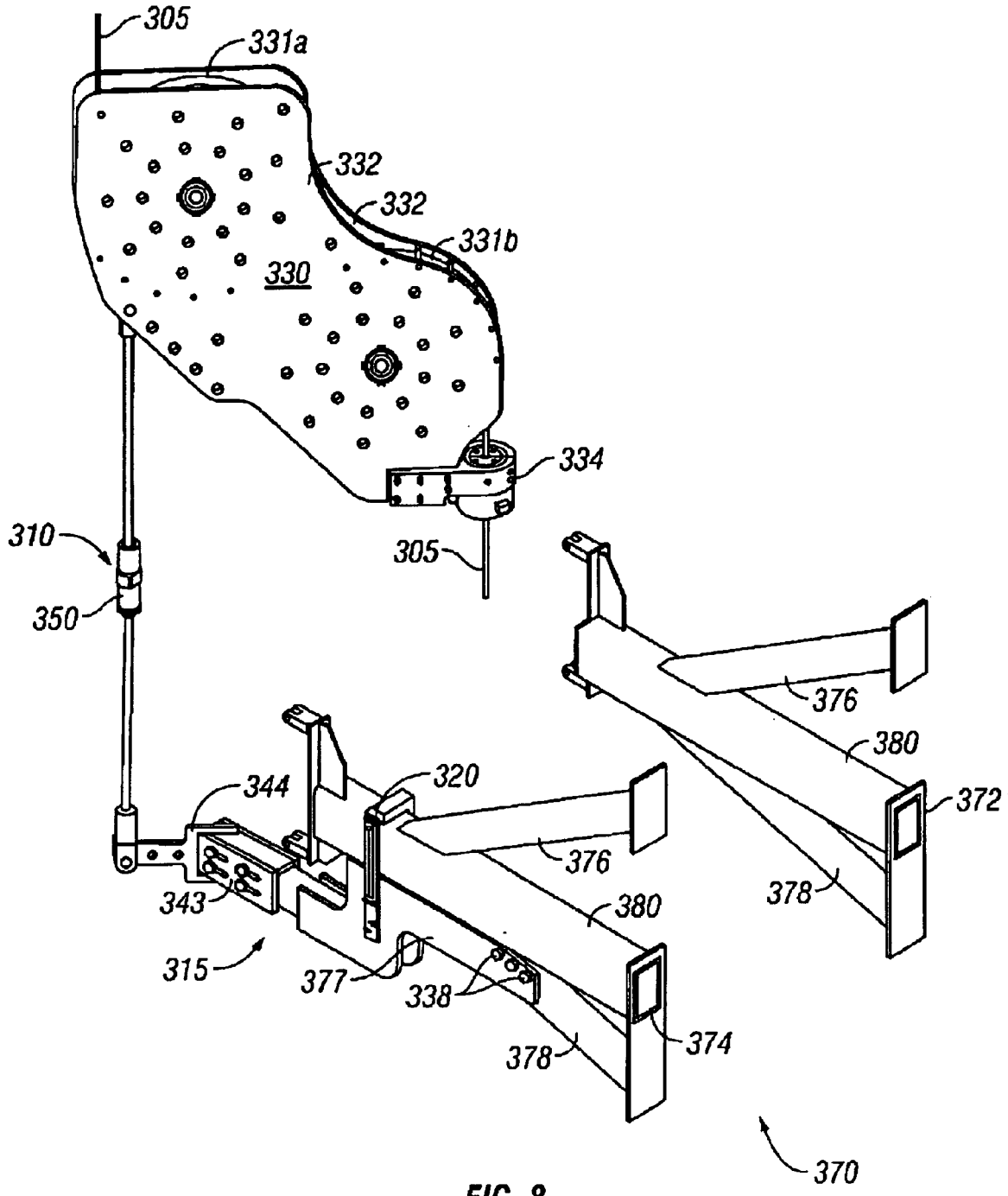
FIG. 8 is a right side rear perspective view drawing showing the bracket assembly of FIG. 7 and a tension rod assembly used in conjunction with a wireline top entry access system sheave assembly.

Referring now to FIG. 8, bracket assembly 315 of FIG. 7 is shown attached to a dolly assembly 370 of a top drive system (not shown). Top drive dolly 370 includes a pair of arms 372, 374, each with an upper 376, lower 378, and middle 380 truss. Bracket assembly 315 is installed on dolly 370 by placing it over lower truss 378 of arm 374 and bolting it in place. Gusset brackets 337 surround lower truss 378 and are compressed securely against truss 378 when bolts 338 are tightened. A sheave wheel assembly is then located into position over the top drive unit (not shown) and a conduit 305 is disposed therethrough. Sheave wheel assembly includes a top wheel 331*a*, a lower wheel 331*b*, a pair of side plates 332 and a gooseneck assembly 334. Bracket assembly 315, together with a tension rod assembly 310, help keep sheave wheel assembly 330 in place to prevent damage to gooseneck 334. This is accomplished by connecting tension rod assembly 310 between sheave wheel assembly 30 and bracket assembly 315 by properly adjusting turnbuckle 350, adjustment cap 343, and mounting hole 344*a*.

Figure 9:
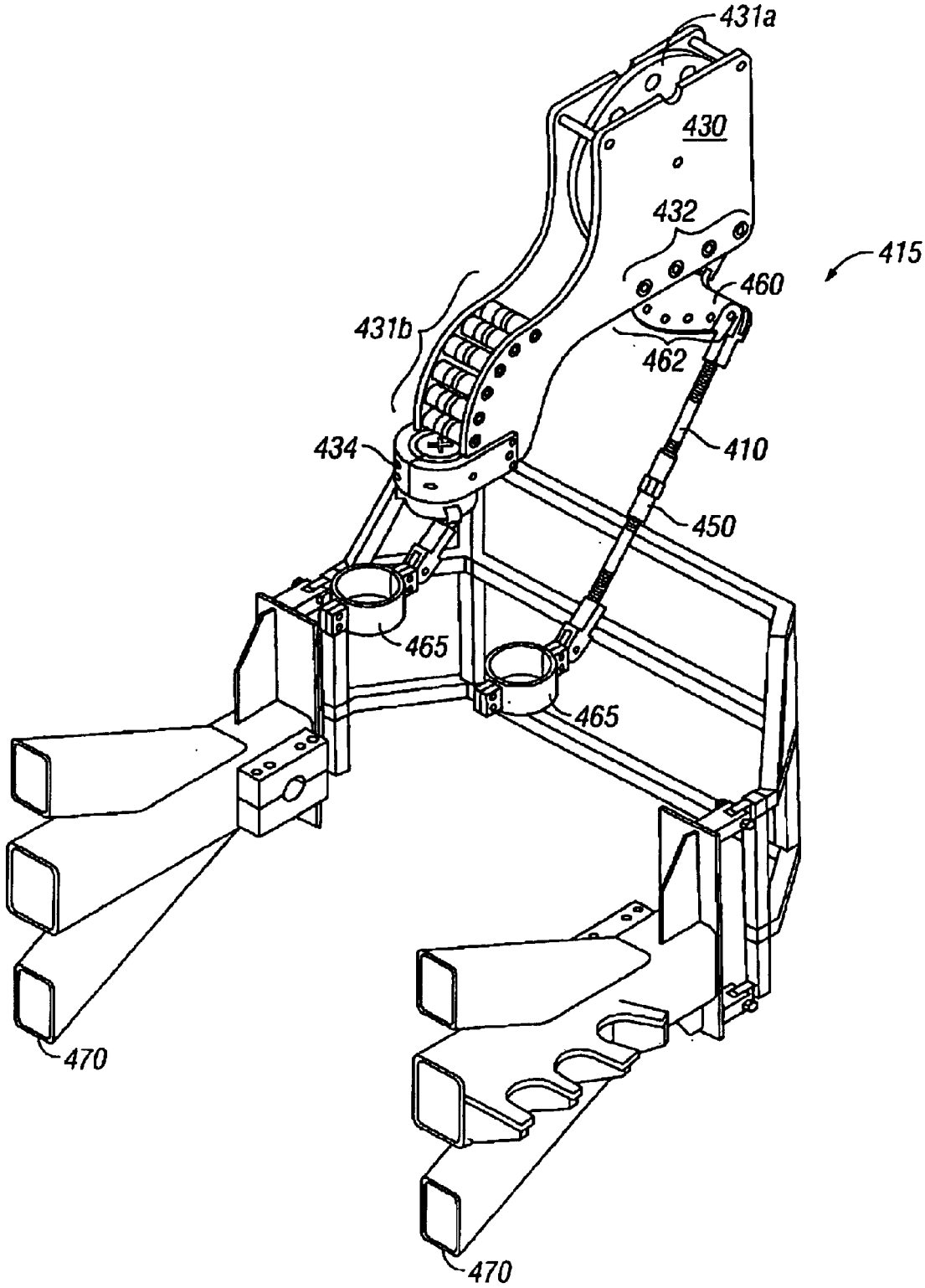
FIG. 9 is a left side rear perspective view of a bracket and tension rod assembly in accordance with a fourth preferred embodiment of the present invention.

Referring now to FIG. 9, a third preferred embodiment of a bracket assembly 415 in accordance with the present invention is shown. Bracket assembly 415 shown is one designed for attachment to "bailes" of a top drive assembly (not shown). The bailes (not shown) are large, bar-shaped links that act like links of a chain between the lifting hook of the derrick not shown and the top drive assembly. This arrangement would be beneficial in situations where the drilling operation company desired that nothing be attached, even removably, to the dolly 470 of the top drive assembly. Bracket assembly 415 includes a main bracket 460, a pair of tension rod assemblies 410, a pair of bail clamps 465, and a sheave wheel assembly 430.

Sheave wheel assembly 430 shown in FIG. 9 is departure from that shown in FIGS. 3, 4, and 8 in that sheave wheel assembly 430 is of a compact configuration. Instead of sheave wheel assembly 430 having two large-diameter sheave wheels, assembly 430 has an upper sheave wheel 431*a* and a plurality of small diameter rollers 431*b* arranged in an arcuate pattern to simulate the curvature of a sheave wheel. It is important to note that bracket assembly 415 of FIG. 9 (or bracket assemblies 15, 215, and 315 of the preceding Figures) is capable of being used with either a standard sheave wheel (for example, item 330 of FIG. 8) or the compact sheave wheel assembly 430 of FIG. 9.

Main bracket 460 of bracket assembly attaches to sheave wheel assembly 430 at any one of a plurality of holes 432. Connection methods between sheave wheel assembly 430 and main bracket 460 are any number of those currently available to those skilled in the art, but preferably is of a shear-pin design. From main bracket 460, two tension rod assemblies 410 attach at a plurality of holes 462 upon bracket 460 and extend downwardly until they each terminate at a ball clamp 465. Bail clamps 465 are analogous to tie brackets 44, 244, and 344 of FIGS. 1, and 4–8 in that they allow the positional adjustment of the lower ends of tension rod assemblies 410. Ball clamps are preferably constructed as simple pipe clamps but may be of any design that is capable of securely fastening to the bailes. Bail clamps 465 may be adjusted along the bailes in a manner similar to the adjustment of adjustment caps 43, 343 and adjustment arm 243. With clamps 465 securely tightened upon bailes (not shown), a turnbuckle 450 is then adjusted on each tension rod assembly 410 to properly position and resist movement of sheave wheel assembly 430. The movement of sheave wheel assembly is restricted to prevent seal elements contained within a gooseneck 434 at its lower end from being damaged by changes in loading that might otherwise deflect sheave wheel assembly 430.

While preferred embodiments of the present invention are shown, it should be understood that alternatives not shown still fall within the spirit and scope of the invention. Generally, various changes in the size, shape, and materials, as well as the details of the illustrated operation and construction may be made. More particularly, different embodiments for the bracket assemblies 15, 215, 315, and 415 and tension rod assemblies 10, 210, 310, and 410 may be employed. Specifically, the actual design and configuration of mountings for components of the present invention will differ from one installation to another because of variables including, but not limited to, the make and model of the top-drive assembly to be installed upon, customer preferences, and regional safety requirements. It should be understood that the preferred embodiments shown are capable of being adapted and modified to accommodate a wide array of top drive assemblies. Furthermore, it should be understood that features of the present invention may be integrated into the design of top drive assemblies (contrasted from the aftermarket installation herein disclosed) without departing from the spirit of the invention.

Finally, in some installations, tension rod assemblies 10, 210, 310, and 410 may be constructed of tension-only members (i.e. wire rope) or real-time adjustable load members (i.e. hydraulic piston ram or mechanical ball or screw) without departing from the spirit and scope of the invention. Such a real-time adjustable load members would enable an operator (or an automated system) to continuously adjust the load on tension rod assemblies 10, 210, 310, and 410 for various downhole and wirelines conditions to optimize performance of Top Entry Access System and sheave wheel 30, 330, and 430 assemblies. It should also be understood that a system in accordance with a preferred embodiment of the invention will be capable of allowing access of various forms of elongate conduits into a wellbore. Examples of said conduits include, but are not limited to, wireline, fiber optic cable, slickline, and coiled tubing.

What is claimed is:

1. An access system for a top drive drilling rig to allow the entry of a conduit into a bore of a tubular string, the access system comprising:

a sheave assembly, said sheave assembly configured to accept and displace the conduit, said sheave assembly extending radially outward from the tubular sting;

a gooseneck assembly to position said sheave assembly with respect to a top portion of the tubular string;

a bracket assembly depending from a dolly of the top drive drilling rig, said bracket assembly including a tie bracket; and a tension rod assembly to connect from said tie bracket to said sheave assembly.

2. The access system of claim 1 wherein the conduit is selected from the group consisting of wireline, slickline, coiled tubing, and fiber optic cable.

3. The access system of claim 1 wherein said tie bracket extends radially outward of said bracket assembly in a direction substantially parallel to said sheave assembly.

4. The access system of claim 1 wherein said bracket assembly further includes an adjustment device, said adjustment device having said tie bracket mounted at a distal end and said adjustment device being configured to be slidably adjustable with said bracket assembly.

5. The access system of claim 1 wherein said tension rod assembly is configured to carry compressive and tensile loads.

6. The access system of claim 1 wherein said tension rod assembly includes a load member, said load member having attachment lugs at either end.

7. The access system of claim 6 wherein said load member is a single solid bar.

8. The access system of claim 6 wherein said load member includes a pair of solid bars, said solid bars configured in series with a turnbuckle disposed therebetween.

9. The access system of claim 8 wherein said turnbuckle is configured to adjust a relative position between said bracket assembly and said sheave wheel assembly.

10. The access system of claim 8 wherein said turnbuckle is configured to adjust tensile and compressive forces between said bracket assembly and said sheave wheel assembly.

11. The access system of claim 6 wherein said load member includes a hydraulic cylinder.

12. The access system of claim 11 wherein said hydraulic cylinder is configured to adjust a relative position between said bracket assembly and said sheave wheel assembly.

13. The access system of claim 11 wherein said hydraulic cylinder is configured to adjust tensile and compressive forces between said bracket assembly and said sheave wheel assembly.

14. The access system of claim 6 wherein said load member includes a ball screw device.

15. The access system of claim 14 wherein said ball screw device is configured to adjust a relative position between said bracket assembly and said sheave wheel assembly.

16. The access system of claim 14 wherein said ball screw device is configured to adjust tensile and compressive forces between said bracket assembly and said sheave wheel assembly.

17. The access system of claim 6 wherein said load member includes wire rope.

18. The access system of claim 1 wherein the tie bracket is integral with the dolly of the top drive drilling rig.

19. A bracket assembly to support a sheave wheel assembly on a top-drive unit, the bracket assembly comprising:

an extension member configured to attach to a dolly of the top-drive unit;

a vertical support member attached to said extension member, said vertical support member configured to attach to an outwardly extending portion of the dolly;

an adjustment device attached to said extension member, said adjustment device adjustably connected to said extension member;

a clevis tie bracket affixed to said adjustment device, said clevis tie bracket configured to be connected to a load member having a lower clevis connector, said lower clevis connector configured to attach to said clevis tie bracket; and said load member also including and an upper end connector, said upper end connector configured to attach to the sheave wheel assembly to provide adjustable support for the upper sheave wheel assembly.

20. A method to access a bore of a tubular string with an elongate conduit while using a top-drive drilling rig, the method comprising the steps of:

securing a sheave wheel assembly to the top-drive drilling rig, the sheave wheel assembly located above a top portion of the tubular string;

connecting a swivel between the sheave assembly and the tubular string;

connecting a bracket assembly to a component of the top drive drilling rig, the bracket assembly including a tie bracket;

connecting a tension rod assembly between the sheave wheel assembly and the tie bracket of the bracket assembly; and introducing the elongate conduit into the bore of the tubular string.

21. The method of claim 20 further comprising the step of manipulating an adjustment device in the tension rod assembly to manipulate a relative position and a relative load between the tie bracket and the sheave wheel assembly.

22. The method of claim 20 wherein the component of the top drive drilling rig is an arm of a dolly.

23. The method of claim 20 wherein the component of the top drive drilling rig in a set of bailes.

24. The method of claim 20 wherein the bracket assembly and the tie bracket are integrated with the component of the tip drive drilling rig.

25. An access system for a top drive drilling rig to allow the entry of a conduit into a bore of a tubular string, the access system comprising:

a sheave assembly, said sheave assembly configured to accept and displace the conduit, said sheave assembly extending radially outward from the tubular sting;

a gooseneck assembly to position said sheave assembly with respect to a top portion of the tubular string;

a bracket assembly depending from a component of the top drive drilling rig, said bracket assembly including a tie bracket; and a tension rod assembly to connect from said tie bracket to said sheave assembly.

26. The access system of claim 25 wherein the component of the top drive drilling rig is a dolly.

27. The access system of claim 25 wherein the component of the top drive drilling is a set of bailes.

28. The access system of claim 25 wherein said sheave assembly includes a first and a second displacement member, said first displacement member configured to displace the conduit from a substantially vertical position to a substantially horizontal position, said second displacement member configured to displace the conduit from a substantially horizontal position to a substantially vertical position.

29. The access system of claim 28 wherein said first displacement member is a single wheel.

30. The access system of claim 28 wherein said second displacement member is a single wheel.

31. The access system of claim 28 wherein said first displacement member is a plurality of rollers arranged in an arcuate profile.

32. The access system of claim 28 wherein said second displacement member is a plurality of rollers arranged in an arcuate profile.

33. An access system to allow the entry of a conduit into a bore of a tubular string in a top drive drilling rig, the sheave wheel assembly including:

a sheave wheel assembly;

a gooseneck assembly to locate the sheave wheel assembly with respect to a top portion of the tubular string;

said gooseneck providing a pack-off device to prevent the escape of bore fluids from the tubular string;

a tension rod assembly, said tension rod assembly configured to maintain the sheave wheel assembly and said gooseneck in a desired position;

said tension rod assembly terminating at the sheave wheel assembly at an upper end; and said tension rod assembly terminating at a top drive drilling rig component at a lower end.

34. The access system of claim 33 wherein said drilling rig component is a dolly.

35. The access system of claim 33 wherein the tension rod assembly is a plurality of tension rod members.

36. The access system of claim 35 wherein said drilling rig component is a set of bailes.

37. The access system of claim 33 further comprising a first and a second displacement member, said first displacement member configured to displace the conduit from a substantially vertical position to a substantially horizontal position, said second displacement member configured to displace the conduit from a substantially horizontal position to a substantially vertical position.

38. The access system of claim 37 wherein said first displacement member is a single wheel.

39. The access system of claim 37 wherein said second displacement member is a single wheel.

40. The access system of claim 37 wherein said first displacement member is a plurality of rollers arranged in an arcuate profile.

41. The access system of claim 37 wherein said second displacement member is a plurality of rollers arranged in an arcuate profile.

* * * * *

UNITED STATES PATENT AND TRADEMARK OFFICE

CERTIFICATE OF CORRECTION

PATENT NO. : 6,907,934 B2 
DATED : June 21, 2005
INVENTOR(S) : Vernon E. Kauffman and Dwight R. LeBlanc It is certified that error appears in the above-identified patent and that said Letters Patent is hereby corrected as shown below:

Column 3,
Line 30, insert the word -- to -- after the word "used".

Column 5,
Lines 8, 9, 43, 44 and 46, replace the word "bailes" with -- bails --;
Line 41, replace the word "Ball" with -- Bail --.

Column 6,
Line 30, replace the word "sting" with -- string --.

Column 7,
Line 67, the text "in a set of bailes." should be replaced with -- is a set of bails. --.

Column 8,
Line 3, replace the word "tip" with -- top --;
Line 9, replace the word "sting" with -- string --;
Lines 20 and 58, replace the word "bailes" with -- bails --.

Signed and Sealed this

Thirtieth Day of August, 2005

JON W. DUDAS
*Director of the United States Patent and Trademark Office*